US009233295B2

(12) United States Patent
Indulti

(10) Patent No.: US 9,233,295 B2
(45) Date of Patent: Jan. 12, 2016

(54) DEVICE FOR REMOVABLY BLOCKING A CENTRAL-FRONT PART OF A SKI BOOT TO A PLATFORM OF A SKI FOR ACTUATING THE TELEMARK TECHNIQUE

(71) Applicant: ATK RACE S.r.l., Fiorano Modenese (Modena) (IT)

(72) Inventor: Giovanni Indulti, Fiorano Modenese (IT)

(73) Assignee: ATK RACE S.r.L., Florano Modenese (IT)

( * ) Notice: Subject to any disclaimer, the term of this patent is extended or adjusted under 35 U.S.C. 154(b) by 120 days.

(21) Appl. No.: 14/090,452

(22) Filed: Nov. 26, 2013

(65) Prior Publication Data

US 2014/0159345 A1 Jun. 12, 2014

(30) Foreign Application Priority Data

Nov. 28, 2012 (IT) ..... BO2012A0645

(51) Int. Cl.
*A63C 9/00* (2012.01)
*A63C 9/08* (2012.01)
(Continued)

(52) U.S. Cl.
CPC ..... *A63C 9/00* (2013.01); *A63C 9/0805* (2013.01); *A63C 9/086* (2013.01); *A63C 9/0807* (2013.01); *A63C 9/08521* (2013.01); *A63C 9/08528* (2013.01); *A63C 2201/06* (2013.01)

(58) Field of Classification Search
CPC ..... A63C 9/00; A63C 9/0807; A63C 9/0805; A63C 9/086; A63C 9/08528; A63C 9/08521; A63C 2201/06
USPC ..... 280/611, 614, 615, 623, 624, 625
See application file for complete search history.

(56) References Cited

U.S. PATENT DOCUMENTS 3,638,959 A * 2/1972 Reuge ..... 280/625
3,863,942 A * 2/1975 Burger ..... 280/621
(Continued)

FOREIGN PATENT DOCUMENTS

CH 626260 A5 11/1981
DE 202010006102 U1 8/2010
(Continued)

OTHER PUBLICATIONS

European Search Report for Corresponding application EP 13 19 4624, completed Feb. 21, 2014, 3 pages.

*Primary Examiner* — Paul N Dickson
*Assistant Examiner* — Bridget Avery
(74) *Attorney, Agent, or Firm* — R. Neil Sudol; Henry D. Coleman

(57) ABSTRACT

The invention is a device for removably blocking a central-front part of a ski boot to a ski platform for actuating a Telemark technique. The boot sole (51) forms, at a bottom thereof, two lateral edges, internal and external (52A, 52B). A plate (1) is blockable to the ski platform, a blocking device (17, 18) constrained to the plate, which bear at least two ratchets. The ratchets are associated with the bottom of the boot supported by the plate, to corresponding edges of the internal edge (52A) and external edge (52B). An activator (16, 24) for the blocking device is supported by the plate, defining two configurations of the blocking device, respectively inoperative (11), with a disengagement of the ratchets from the corresponding edges (52A, 52B) and operative ($\mathbf{1}_2$), with a blocking of the two edges against the plate (1).

13 Claims, 8 Drawing Sheets

(51) Int. Cl.
*A63C 9/085* (2012.01)
*A63C 9/086* (2012.01)

(56) References Cited

U.S. PATENT DOCUMENTS 4,143,886 A * 3/1979 Salomon ..... 280/624
4,145,071 A * 3/1979 Salomon ..... 280/624
4,322,090 A 3/1982 Loughney
8,544,869 B2 * 10/2013 Lehner ..... 280/611
8,894,087 B2 * 11/2014 Barthel et al. ..... 280/614
2013/0087992 A1 * 4/2013 Ibach et al. ..... 280/626
2013/0328289 A1 * 12/2013 Vailli et al. ..... 280/625

FOREIGN PATENT DOCUMENTS

EP 2392388 A1 12/2011
EP 2452731 A1 * 5/2012 ..... A63C 9/08
WO WO79/00311 A1 6/1979

* cited by examiner

DEVICE FOR REMOVABLY BLOCKING A CENTRAL-FRONT PART OF A SKI BOOT TO A PLATFORM OF A SKI FOR ACTUATING THE TELEMARK TECHNIQUE

RELATED APPLICATIONS

This application claims priority in Italian Patent Application no. BO 2012A 000645, the contents of which are hereby incorporated by reference.

TECHNICAL FIELD

The present invention relates to the technical sector concerning the realizing of devices for skiing according to the Telemark technique, and more precisely it concerns a device for removably blocking the ski of the central-front part of a boot.

BACKGROUND

As is known, Telemark is a classic and elegant technique for curving or halting with skis, which has returned to popularity in cross-country skiing. This consists of bringing the external ski forward when curving, bringing one ski in front of the other and placing the body weight on it, while the knee of the internal leg is flexed up to brushing the ski, and the arms are spread so as to facilitate balance.

Devices are known that can be used only with corresponding boots.

The boots, in the rear part of the sole, form a transversal recess that defines a projection, with two seatings fashioned in the toe-piece of the sole.

These devices are constituted by a ratchet system to which two arms are connected, activatable by levers, for example a maneuvering lever and a safety lever hinged to the ski upstream with respect to two abutments that are complementary to the seatings.

The skier couples the seatings of the sole with the abutments. Following this, the ratchet is positioned at the projection position.

In a known way, intervention is made in order on the maneuvering lever and the safety lever, with a consequent forced enveloping of the projection by the ratchet. This leads to the removable blocking to the ski of the central-front part of the boot, the heel of the boot being de-constrained from the ski.

The drawback of the above devices derives from the fact that it is necessary to realize boots that can receive them, with the consequent costs this incurs.

Further devices are known that comprise an abutment formed by a plate blockable to the ski, against which the front part of the boot abuts, with two tie-rods, developing either by a side of or below the boot positioned on the plate, being subjected upstream to an activating device and connected downstream to a sort of jaw destined to embrace the lower-rear part of the boot.

The tie-rods are tensioned by use of the activating device. In this way the boot is constrained to the plate but the relative notch is disengaged therefrom.

The constructional complications of the devices described above are evident.

SUMMARY OF THE INVENTION

The aim of the invention is to provide a device with which a skier can employ the Telemark technique, which device obviates the drawbacks in the prior art.

A further aim of the invention is to provide a device that is usable with boots provided in the front part with two bushings for Alpine skiing and forming, in the soles, lateral edges that project with respect to the upper.

A further aim of the invention consists in realizing a device that cooperates with structures associated with a toe-piece for Alpine skiing.

A further aim consists in providing a device that can be associated with a toe-piece for Alpine skiing or a plate, blockable to the ski, provided with abutments for the front part of the boot.

The above-indicated aims are attained by the invention as described further below.

BRIEF DESCRIPTION OF THE DRAWINGS

Further characteristics and advantages of the invention will emerge from the description that follows, which makes reference to the appended tables of drawings, in which.

DETAILED DESCRIPTION OF THE INVENTION

Figure 1:
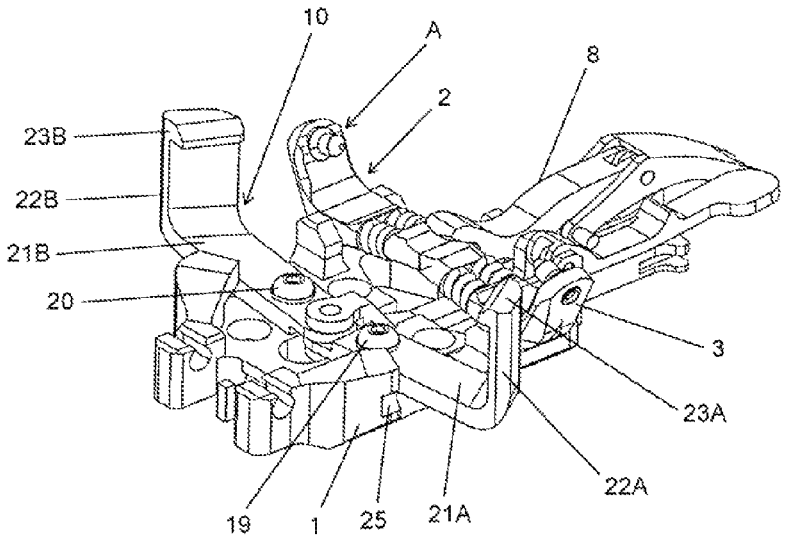
FIGS. 1, 2, and 3 illustrate the device of the invention, associated to a toe-piece, in both the relative inoperative configurations, respectively in a perspective view, a view from above and in a section view taken along plane III-III of FIG. 2.

With reference to the figures, 1 denotes a plate, blockable in a known way to a ski (not illustrated) which supports a toe-piece 2 and a device 10 of the invention.

The toe-piece 2, for example of the type disclosed in Italian patent IT 1.378.791 and belonging to the applicant hereof, comprises two equal and opposite jaws 3, symmetrical with respect to a longitudinal and oscillating plane according to relative longitudinal axes. The jaws superiorly bear corresponding pins 4, facing in an internal direction and abut with their lower heads, the ends of springs 5, the remaining ends of which springs 5 abut a relative component 6 of a joint 7.

Figure 6:
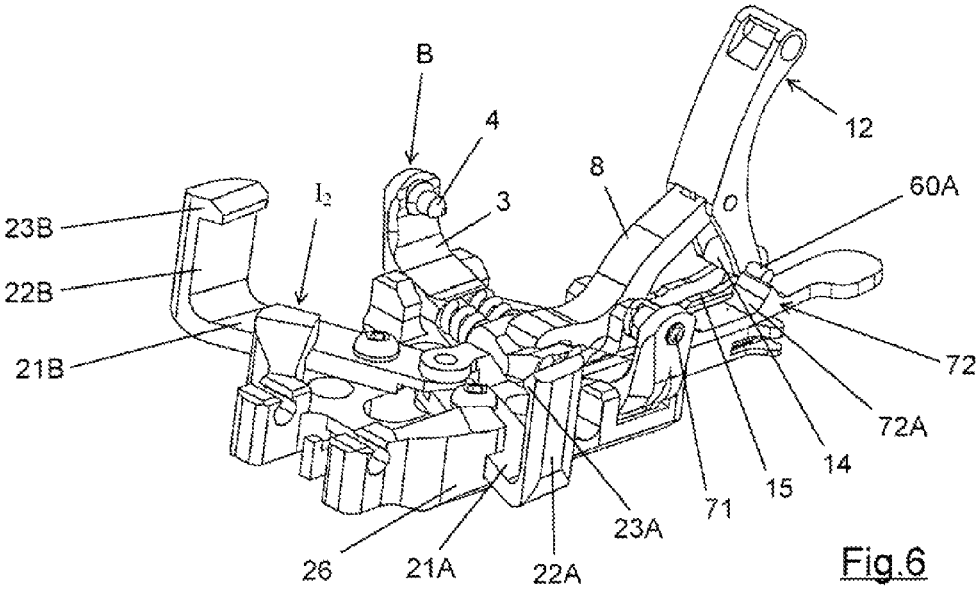
FIGS. 6, 7, 8, 9, and 10 illustrate the above device and toe-piece, both in the relative operative configurations, respectively, in a perspective view, from above and in a section view taken along plane VIII-VIII of FIG. 7, in a section view taken along plane IX-IX of FIG. 7, and in a section view taken along plane X-X of FIG. 8.
Figure 7:
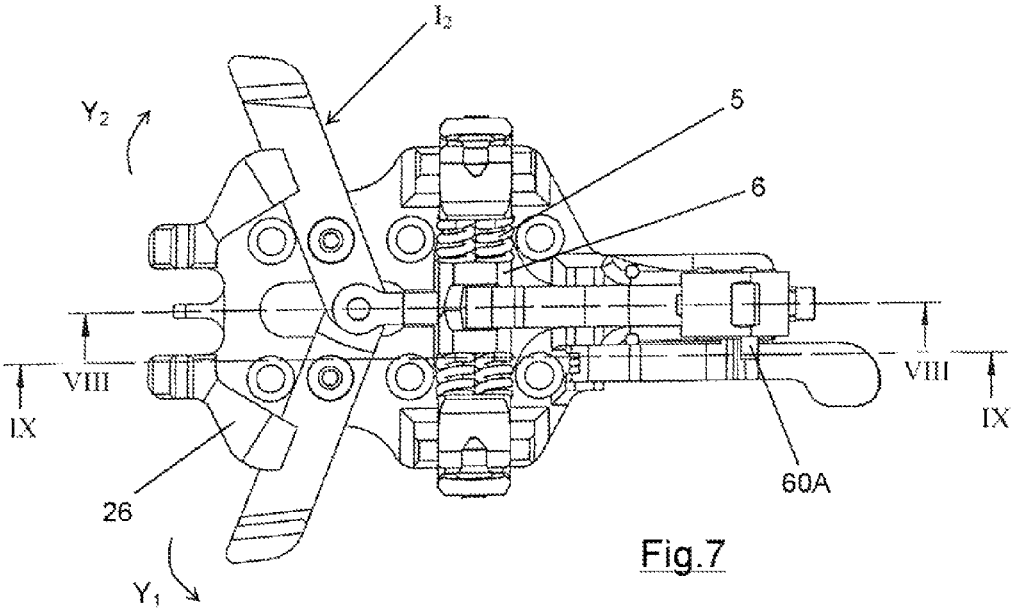

The combined action of the springs 5 and the joint 7 enables defining, as is known, for the jaws 3, two end configurations, respectively an inoperative (or open) configuration A, see FIG. 1, and an operative (or closed) configuration B, see FIGS. 1, 6.

Figure 3:
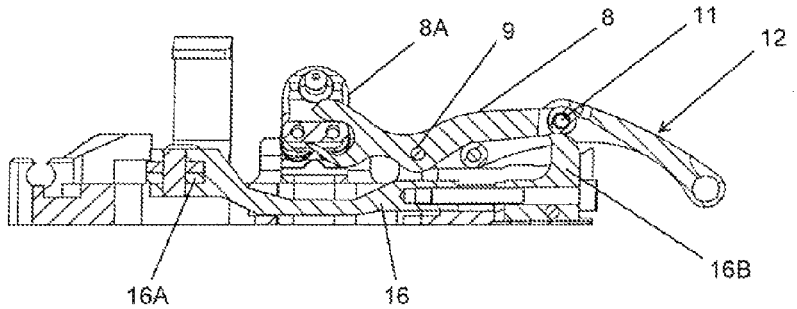
Figure 2:
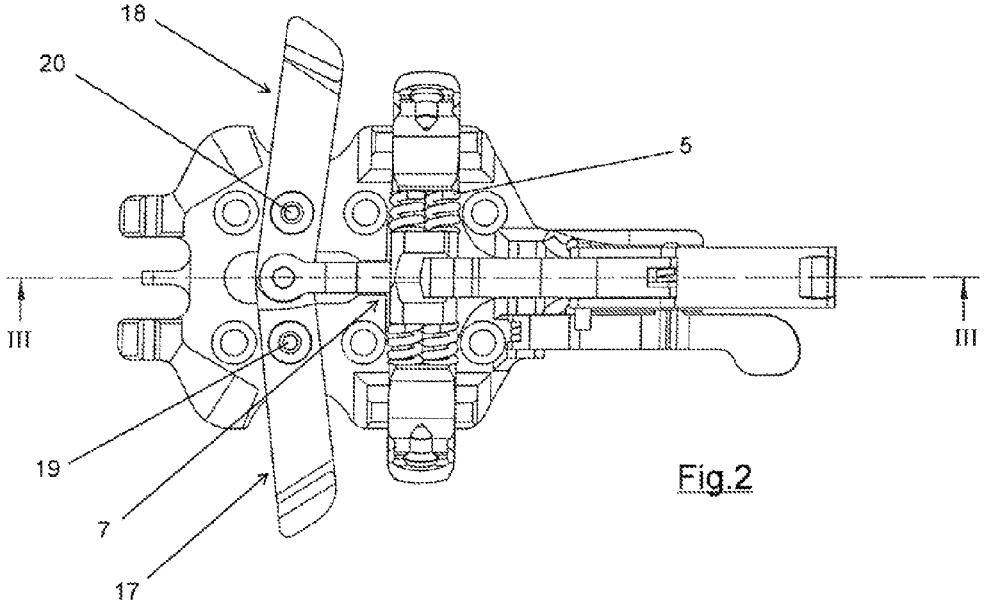

Numeral 8 denotes a main lever, symmetrical with respect to the longitudinal plane, hinged to the plate 1 according to a transversal plane 9. An end 8A of the lever (FIGS. 3, 6) is conformed so as to freely hinge with the joint 7.

Figure 5:
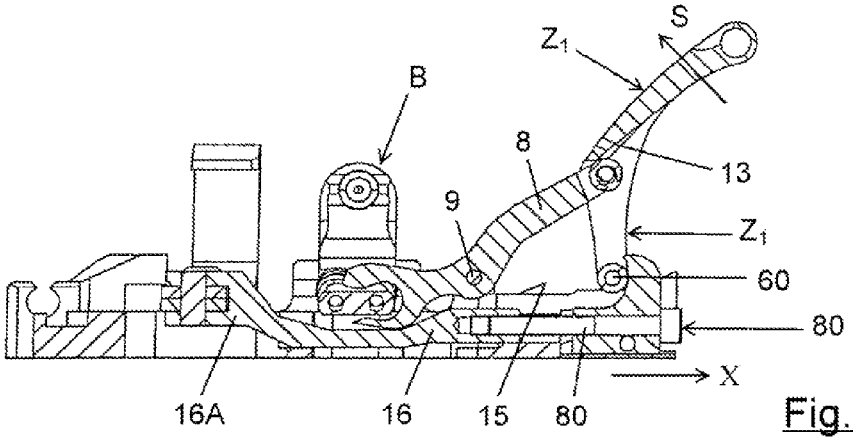
FIGS. 4 and 5 illustrate the devices and toe-piece, respectively in the inoperative and operative configurations, respectively, in a view from above and in a section view along plane V-V of FIG. 4.
Figure 4:
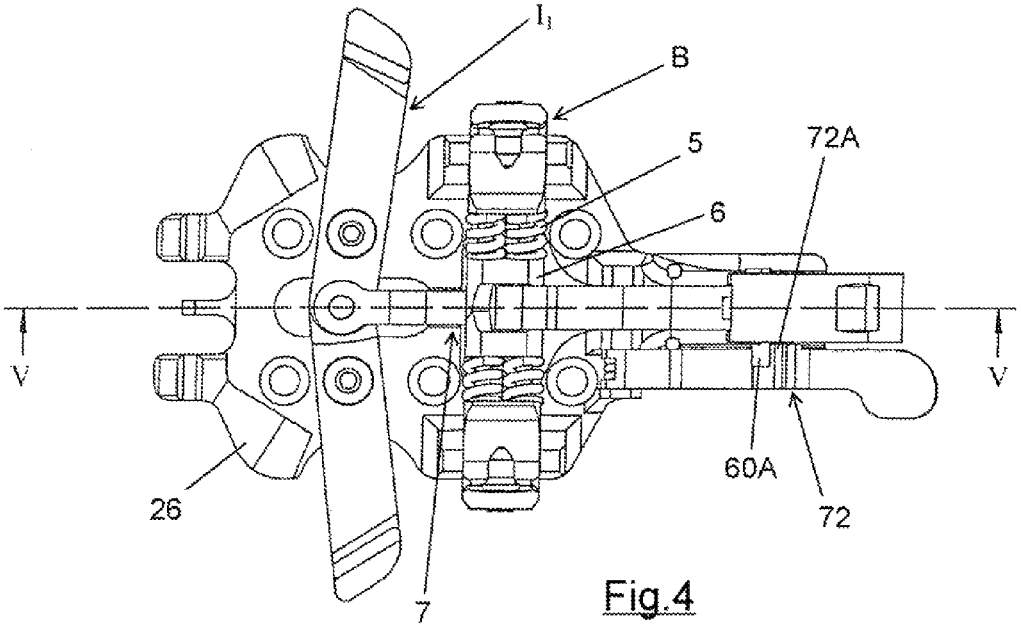
Figure 8:
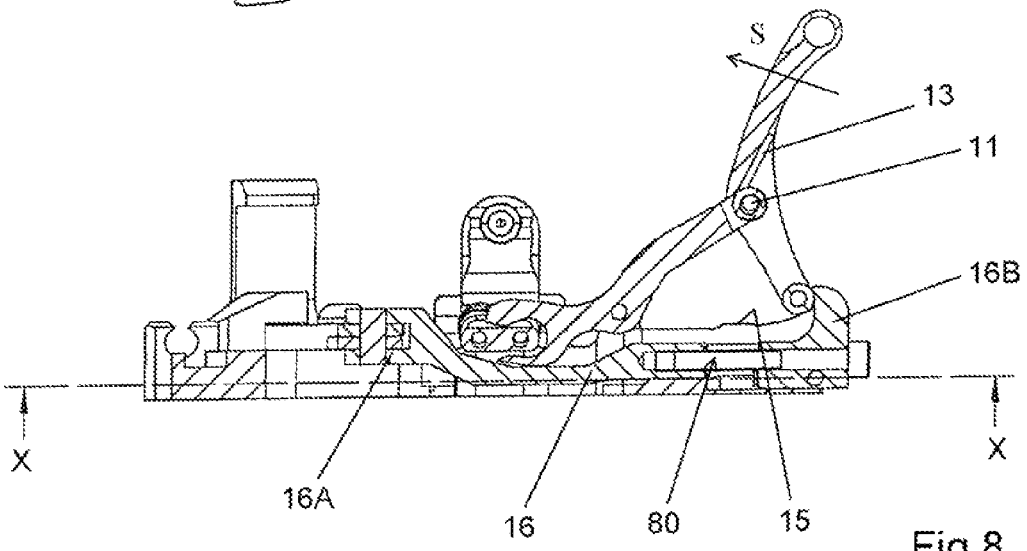

The remaining end of the main lever 8 hinges, by way of a transversal pin 11, the central part of a safety lever 12. An elastic element 13 is borne by the pin 11, and acts on the levers 8, 12 in the opening direction thereof (FIGS. 5, 8).

The function of the elastic element 13 is to open, in scissors fashion, the safety lever 12 with respect to the main lever (see IT patent 1.378.791). This is actuated when the skier, pressing on the joint 7 from above in a downwards direction, overcomes the elastic reaction of the springs 5 in such a way as to bring the jaws 3 into the relative operative configuration B, with a consequent snap-entry of the pins 4 in corresponding bushings realized in the front part of a ski boot 50 (FIGS. 11-14). In this situation, the safety lever is arranged in the position of FIG. 5 or the first position Z1.

The internal end of the safety lever 12 bears a roller 14, which is idle about a pin 60, the roller 14 running on a track 15. The pin projects from a side of the roller by a portion 60A.

Figure 9:
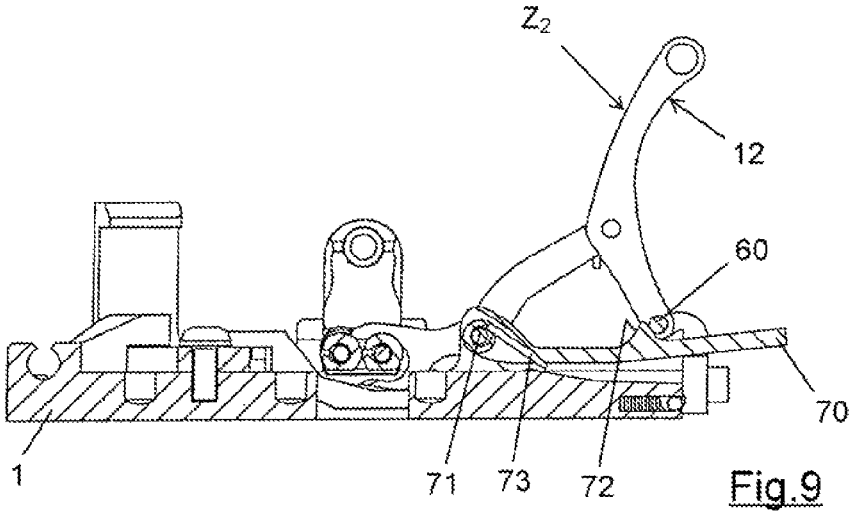

By the side of the track 15, located by a side of the portion 60A of the pin 60, an arm 70 is provided, the downstream end of which is hinged to the plate 1 by way of a transversal pin 71, to which a spring 73 is associated that tends to oppose the downwards oscillations of the arm (see FIG. 9). A tooth 72 is fashioned in the arm 70, facing upwards, against the downstream side 72A of which the portion 60A of the pin 60 abuts (see FIG. 12), with the safety lever 12 in the position Z1.

The device 10 comprises a slide 16, which is symmetrical with respect to the longitudinal plane, the rear end 16A of which is hinged with the internal ends of the internal arms of two identical blocking levers 17, 18, each of which is centrally hinged to relative pins 19, 20, vertical to the plate 1. The pins are symmetrical with respect to the longitudinal plane.

The external arm of each lever 17, 18 is constituted (see FIGS. 1, 6) by three consecutive portions, respectively first portions 21A, 21 B, developing in an external direction, second portions 22A, 22B, developing upwards, and lastly third portions 23A, 23B developing in an internal direction. The third portion forms a ratchet, which is extremely advantageous, as will be described below.

The slide 16 is constituted by two parts, a central-rear part and a front part, joined together by a regulator 80 for regulating the mutual distance between the parts (see FIGS. 5, 8).

Figure 10:
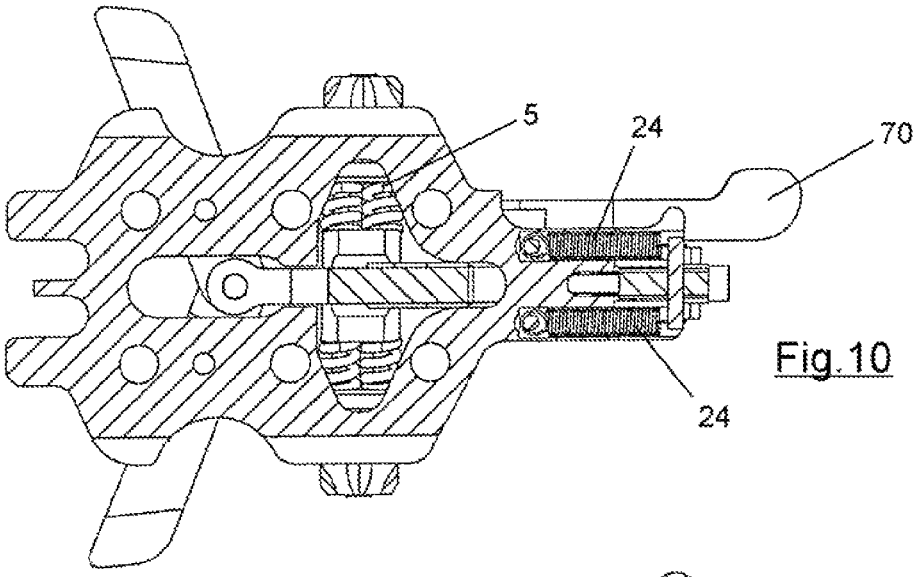

The slide 16 is subjected to an elastic means 24 (FIG. 10) which define, for the blocking levers, the inoperative configuration $\mathbf{1}_1$ (see FIGS. 1, 6).

The slide 16 forms, in the front part thereof, an appendage 16B facing upwards, the roller 14 abutting against the surface of the appendage 16B facing the jaws when the safety lever 12 is in the position 21 of FIG. 5, which is the operative configuration B for the jaws 3.

With reference to FIG. 5, when intervening to rotate the safety lever 12 in direction S, the same direction as the elastic reaction of the spring 13, by the action of the roller 14 of the appendage 16B, a translation of the slide is caused in the longitudinal direction X with a consequent rotation in counter-rotating directions Y1, Y2 of the blocking levers 17, 18 up to defining the operative configuration $\mathbf{1}_2$ of the blocking levers 17, 18 (see FIGS. 6, 7, 8, 9).

At the same time, with the last above rotation, the external portion 60A of the pin 60 of the roller 14 overcomes, in opposition to the spring 73, the downstream ramp 72A of the tooth 72 up to passing beyond the tooth 72 and abutting on the upstream ramp 72B of the tooth, with the position Z2 of the lever 12 (see FIGS. 6-9) stabilizing the operative configuration $\mathbf{1}_2$.

In fact, the stresses acting on the device 10 tending to cause the arm 70 to rotate downwards (with a part 60A of the pin passing beyond the tooth 72) are opposed by the spring 73, with the elastic reaction of the spring 13 also intervening to stabilize the position Z2.

In the operative configuration $\mathbf{1}_2$, the first portion 21A, 21 B of each lever 17, 18 inserts in a seating 25 realized in a block 26 solidly constrained to the plate 1 (FIGS. 1, 6).

With reference to FIGS. 11-14, the boot 50 has, at the sides of the forward front zone, bushings destined to receive the pins 4. This is in fact a boot for Alpine skiing.

The sole 51 of the boot projects laterally from the upper so as to define an edge, more precisely an internal edge 52A and an external edge 52B.

Figure 12:
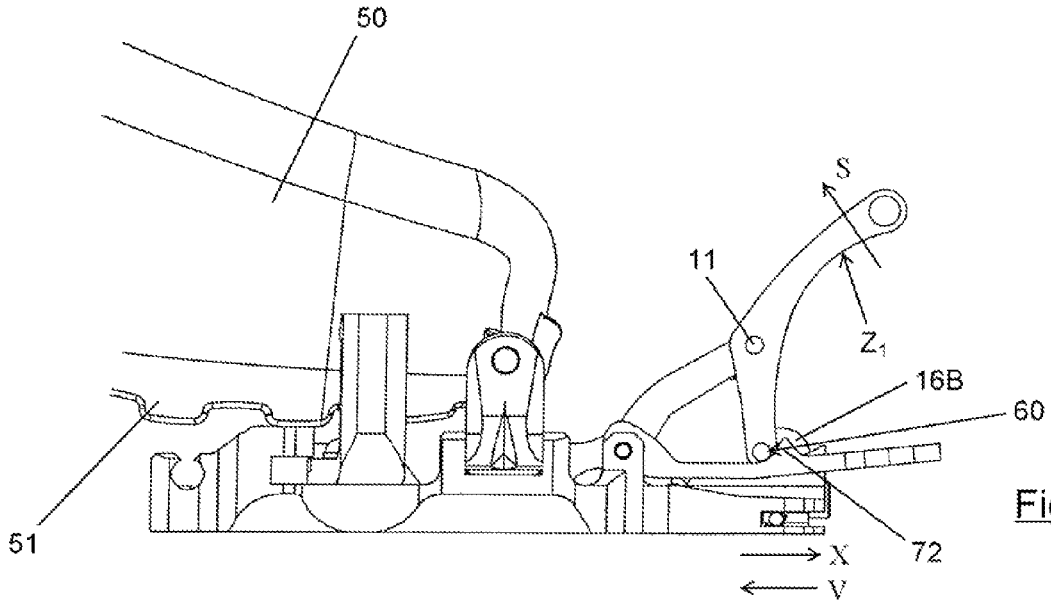
FIGS. 11 and 12 illustrate the device and toe-piece associated to a boot, respectively in the inoperative and operative configurations, respectively, in a view taken from above and a lateral view.
Figure 11:
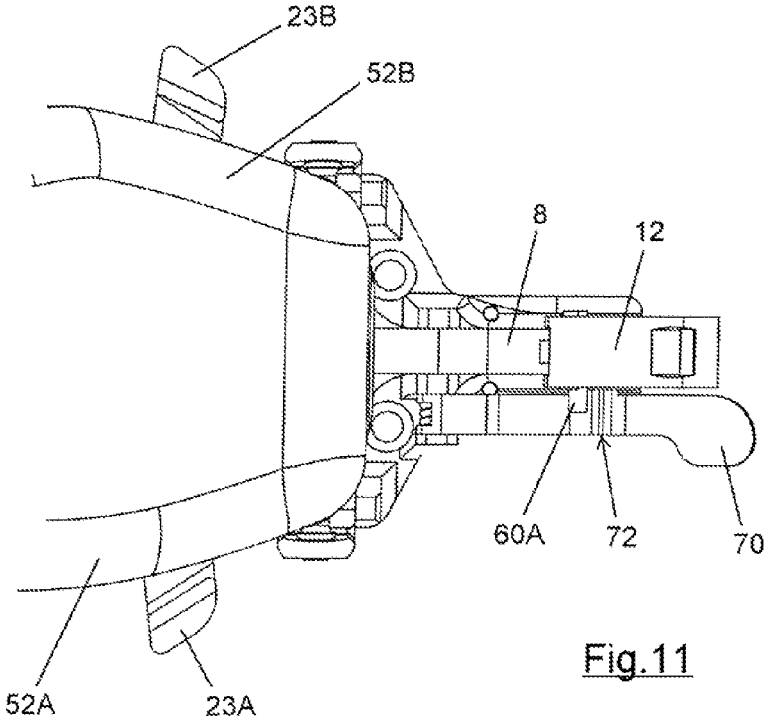
Figure 14:
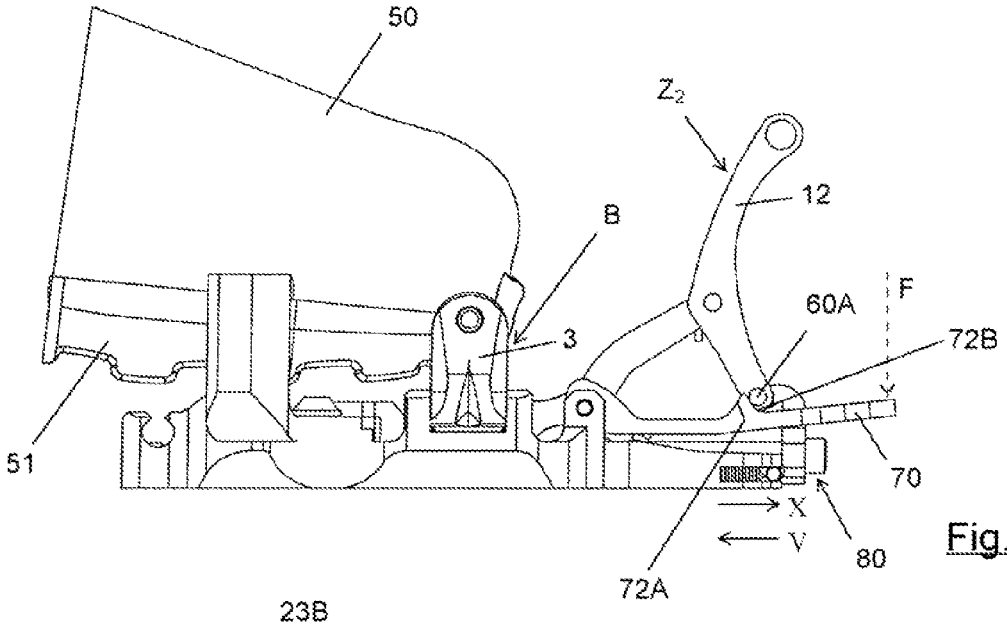
FIGS. 13 and 14 illustrate the device, and the toe-piece of preceding FIGS. 11 and 12, both in the relative operative configurations, respectively, in a view taken from above and a lateral view.

FIGS. 11 and 12 illustrate the boot 50 hooked to the toe-piece 2. The ratchets 23A, 23B of the blocking levers are external of the edges 52A, 52B of the sole 51.

In the situation of FIGS. 11 and 12, the uphill part of Alpine skiing can be carried out.

In order to ski following the Telemark technique, it is necessary to intervene on the safety lever 12 so as to exert thereon a torque couple in direction S, the same direction as the elastic reaction of the elastic element 13, with the roller 14 running on the track 15 (the profile of which exhibits a circular portion coaxial with the pin 11) and intercepting the appendage 16B which, as already described, causes the rotation of the blocking levers 17, 18 in counter-rotating directions Y1, Y2 and the contemporary passing-beyond of the tooth 72 by the portion 60A of the pin 60.

Figure 13:
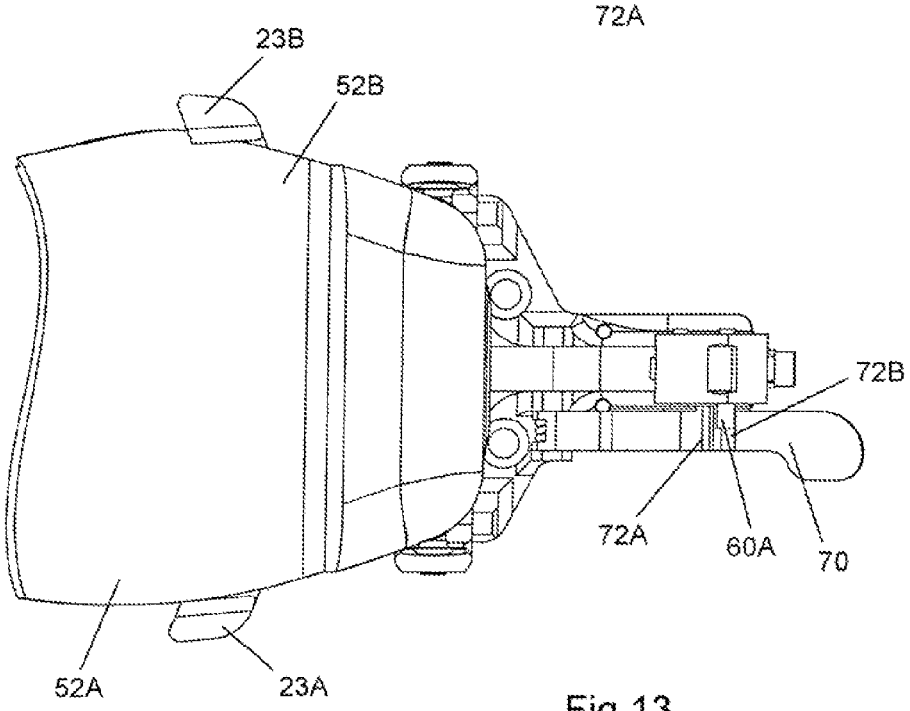

Following the above rotations, the ratchets 23A, 23B of the levers intercept the edges 52A, 52B of the sole 51 (FIGS. 12, 13). This causes the blocking of the edges, and therefore the central-front part of the sole 51, against the underlying plate 1, in operative configuration $\mathbf{1}_2$.

To optimize the locking, the regulators 80 are used, the regulation being consequent upon the inevitable variations of the thickness of the edges 52A, 52B of one boot to another.

In this operative configuration $\mathbf{1}_2$, vertical vibrations are prevented for the blocking levers 17, 18 as they are vertically stabilized by the insertion of the first portions 21A, 21B of the levers 17, 18 in the relative seatings 25 of the blocks 26.

In this way, the combined action of the toe-piece 2 and the blocking device 10 enable the "removable" blocking of the central front part of the boot 50 to the plate 1. The heel (not illustrated) of the boot 50 is in no way connected to the plate 1 (therefore to the ski) so that the rear part of the boot 50 can oscillate with respect to the central-front part thereof, so that the conditions for skiing with the Telemark technique are achieved.

To unblock the ratchets 23A, 23B from the edges 52A, 52B of the sole 51, it is sufficient to intervene on the arm 70 with a force F (denoted in a broken line in FIG. 14) so as to rotate it downwards.

The situation of FIG. 12 is repeated for the arm, which enables the springs 24 to translate the slide 16 in direction V, opposite X, i.e., the inoperative condition $\mathbf{1}_1$ for the blocking levers 17, 18.

The device 10 of the present invention intervenes to block (by way of the ratchets 23A,23B) the edges 52A, 52B of the sole 51 of a ski boot 50 against the plate 1.

In the illustrated embodiments of the drawings, the device 10 is associated to a toe-piece of the type used to actuate at least the uphill stage of Alpine skiing.

This does not constitute a limitation, as the device 10 can be realized independently of the toe-piece, or associated to a different toe-piece from the one illustrated in the accompanying tables.

In the first case, the slide 16 is activated with a relative controller conformed so as to define, for the blocking levers 17, 18, the above-mentioned inoperative $\mathbf{1}_1$ and operative $\mathbf{1}_2$ configurations.

In the second case, i.e. with the device 10 associated to different toe-pieces from the ones illustrated in the appended figures, or to an abutment on the point of the ski boot, the controller for the slide 16 can be enslaved to the toe-piece or the abutment.

The idea underpinning the present invention is that the device 10 is clearly independent of any toe-pieces or abutments of the boot to which it can be associated.

In the illustrated embodiment, the ratchets 23A, 23B are formed by the end portions of the external arms of the blocking levers 17, 18.

The solution of the present invention consists in the fact of having at least two ratchets 23A, 23B positionable in proximity to the external edges 52A, 52B of the central-front part of the sole in a ski boot, moved by a relative activator which define, for the ratchets, the inoperative configuration $\mathbf{1}_1$, in which they are disengaged from the edges, and the operative configuration $\mathbf{1}_2$ in which the ratchets block the edges against the plate 1.

The illustrated embodiment of the activator is constituted by the particular conformation of the blocking levers 17, 18 of the slide 16 and the means for moving the slide 16.

The activator can also be made differently, for example, so as to move the ratchets vertically from a raised position (of disengagement from the edges) to a lowered position of blocking the edges against the plate, with the raised position being such as to enable positioning of the boot on the plate 1.

Figure 15:
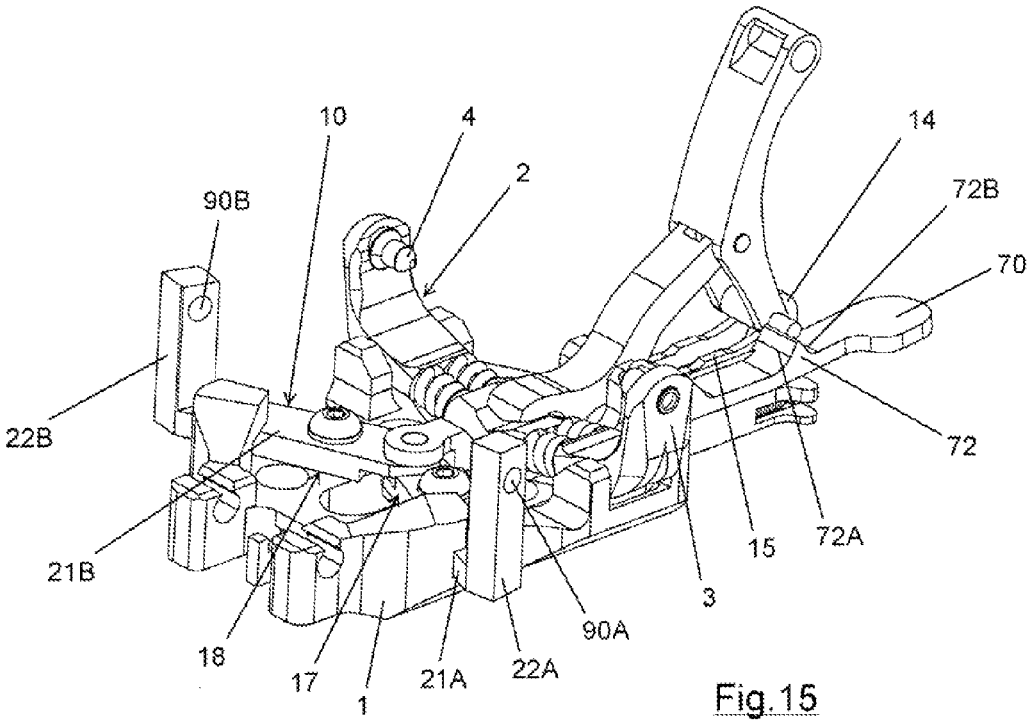
FIGS. 15 and 16 illustrate, associated to a boot, a variant of the device, cooperating with a toe-piece, both in the operative configuration, respectively, in a perspective view and a lateral view.
Figure 16:
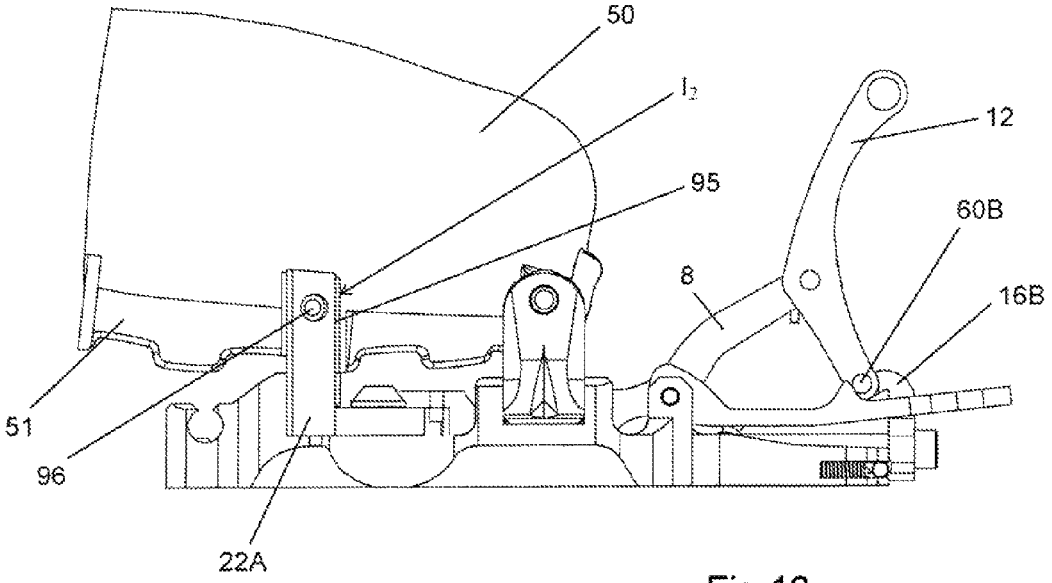

FIGS. 15 and 16 illustrate a variant of the device 10.

The variant includes, for the arms 17, 18, only two positions, respectively the first zone 21A, 21 B and the second zone 21A, 21B.

The second portion 22A, 22B exhibits, in the upper part thereof, a transversal opening 90A, 90B.

In the boot 50, downstream of the bushings (which will accommodate the pins 4), two vertical undercuts 95 are fashioned, one for each lateral-front flank of the boot, destined to receive corresponding portions 22A, 22B. A pin 96 is positioned in each undercut (solidly constrained to the boot using known devices).

The switching of the levers 17, 18 from the inoperative configuration $\mathbf{1}_1$ to the operative configuration 12 causes the second portions 22A, 22B, consequently to rotate the levers 17, 18 in the counter-rotating directions $Y_1$, $Y_2$, inserting in the corresponding undercuts 95 with a contemporaneous entry of the pins 95 into the openings 90A, 90B. In this way, and in cooperation with the toe-piece 2, the blocking of the sole of the boot to the plate is obtained, and therefore of the ski to which the plate 1 is fixed.

Figure 17:
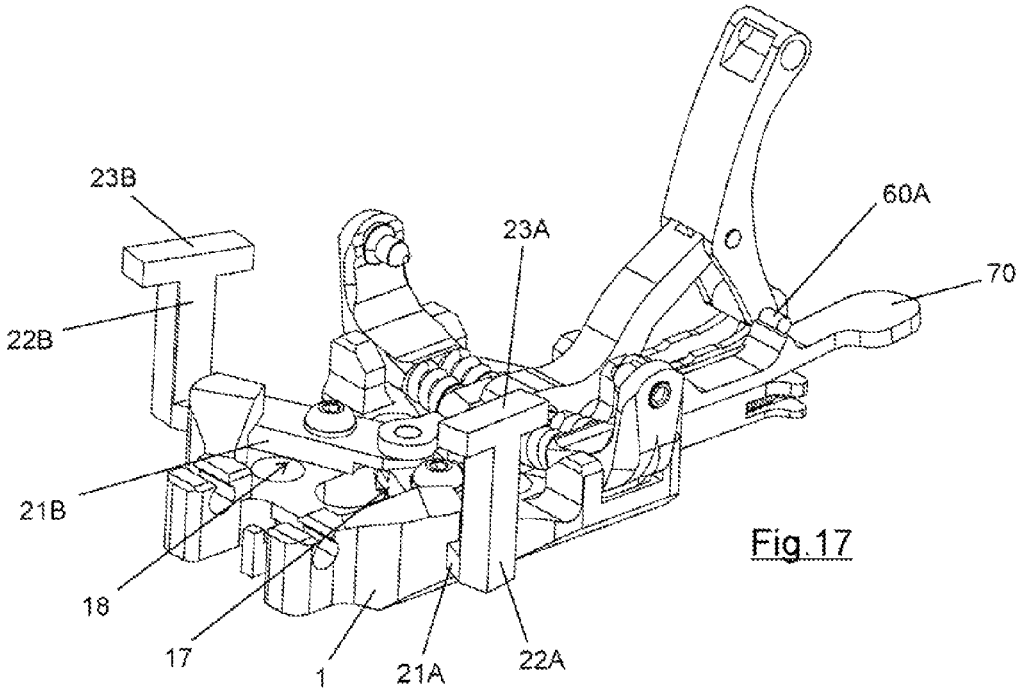
FIGS. 17 and 18 illustrate, in association with a boot, a further variant of the device, cooperating with a toe-piece, both in the operative configuration, respectively, in a perspective view and a lateral view.
Figure 18:
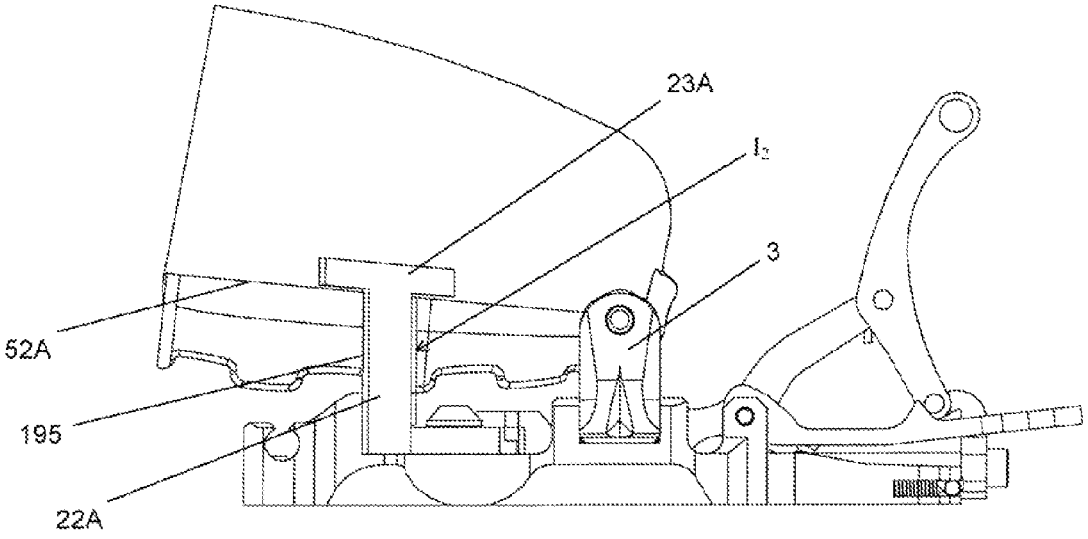

A further variant of the device 10 is illustrated in FIGS. 17, 18.

As evidenced in the figures, the second and third portions 22A, 22B, 23A, 23B form, in combination with one another, a T-shape with the head of the T (i.e. the third portion) facing upwards.

The boot 50 of FIGS. 17 and 18 forms, at the position of the sole, lateral edges of which only edge 52A is illustrated in FIG. 18.

The lateral edges exhibit, downstream of the bushings, vertical undercuts 195, one for each edge, destined to receive corresponding second portions 22A, 22B (i.e. the stalk of the T).

With the rotation of the levers 17, 18 in counter-rotating directions $Y_1$, $Y_2$, the second portions 22A, 22B enter the corresponding undercuts 195 up until the operative configuration $\mathbf{1}_2$ is obtained (FIG. 18).

In this situation, the lower surfaces of the heads of the T intercept the corresponding edges 52. In this way, in cooperation with the toe-piece 2, the sole of the boot is blocked to the plate 1, and therefore to the ski.

In the illustrated embodiments, the positioning of the boot 50 with respect to the device 10 is obtained by way of the toe-piece 2.

As specified in the foregoing, the device 10 can be associated to different toe-pieces from the one illustrated, or to abutments on the tip of the boot. In both cases, there is a predetermined positioning of the boot with respect to the plate 1, and therefore also with respect to the device 10.

If the device 10 is not associated to a toe-piece or to abutments, the positioning of the boot can be done either by using a reference notch located on the plate or by the skier her or himself, being without doubt experienced sufficiently to position the boot correctly with respect to the plate 1 and therefore with respect to the blocking levers 17, 18.

The invention claimed is:

1. A device for removably blocking a central-front part of a ski boot to a platform of a ski for actuating a Telemark technique comprising: a plate, blockable to the ski platform; a blocking device constrained to the plate, which bear at least two ratchets, which ratchets are associated with a sole of the ski boot supported by the plate located at corresponding lateral front parts of the boot; an activator for the blocking device, supported by the plate, the activator defining two configurations of the blocking device, an inoperative configuration with the disengagement of the ratchets from the corresponding lateral front parts of the boot, and an operative configuration with the blocking of the ratchets to the corresponding lateral front parts of the boot, so as to block a central-front part of the boot sole to the plate and so that a rear part of the boot can oscillate with respect to the central-front part, wherein the blocking device comprises two blocking levers centrally hinged by relative vertical pins to the plate, internal ends of internal arms of the levers connected to the activator, external arms of the blocking levers comprising, starting from the relative vertical pin, three consecutive portions, respectively a first portion developing in an external direction, a second portion, developing upwards, and a third portion developing in an internal direction, defining the ratchet.

2. The device of claim 1, further comprising at least two blocks solidly constrained to the plate, having seatings for receiving corresponding first portions of the blocking levers, when the blocking levers are in the operative configuration.

3. The device of claim 1, wherein the activator comprises a slide which is slidably guided longitudinally by the plate, an internal end of which is hinged to the internal ends of the internal arms of the blocking levers; a device for drawing the slide in an operative direction, for switching the blocking levers from the inoperative configuration to the operative configuration acting against an elastic element.

4. The device of claim 2, wherein the activator comprises a slide which is slidably guided longitudinally by the plate, an internal end of which is hinged to the internal ends of the internal arms of the blocking levers; a device for drawing the slide in an operative direction, for switching the blocking levers from the inoperative configuration to the operative configuration acting against an elastic element.

5. The device of claim 3, wherein the slide has two parts connected by a regulator for regulating the pressure with which the ratchets lock to the corresponding front lateral parts of the boot for blocking the central front part of the boot sole against the plate.

6. The device of claim 3, wherein the plate has a toe-piece, situated upstream of the blocking levers comprising two jaws identical and opposite, oscillating according to relative longitudinal axes thereof, which superiorly bear corresponding pins facing in an internal direction, and which abut with the lower heads, first elastic elements which are also abutted by corresponding components of a joint having a longitudinal axis, the joint and the first elastic elements defining, for the jaws, two end configurations, an inoperative configuration with the jaws open and an operative configuration with the jaws closed, the operative configuration enabling insertion of the pins in relative seatings afforded in the front part of the boot, a main lever hinged to the plate according to a transversal axis, of which an end is freely hinged with the joint, a safety lever having a central part hinged, by a transversal pin, to a remaining end of the main lever, a second elastic element borne by the pin and acting on the levers, so as to part the levers, and being designed to position the safety lever, with the jaws in the operative configuration, in a first position in which a relative internal end abuts the plate and the second elastic element, in cooperation with the main lever, opposes the switching of the jaws from the operative configuration to the inoperative configuration, wherein a drawing device is constituted by the internal end of the safety lever and by an appendage located in the slide, the oscillation of the safety lever from the first position to a second position being in a same direction as an elastic reaction of the second elastic element, leading to an intercepting of the internal end against the appendage with a consequent drawing of the slide in the operative direction, and having a stabilizer for stabilizing the second position.

7. The device of claim 6, wherein the internal end of the safety lever idly bears a roller by a pin, the roller sliding on a track, the stabilizer comprising an arm located by a side of the track, a downstream end of which is hinged to the plate by a transversal pin, the arm being provided with a tooth facing upwards; an elastic element opposing a downward oscillation of the arm, a portion of the pin projecting from the relative roller on the side of the arm, designed to abut a downstream ramp of the tooth with the blocking levers in the inoperative configuration, and provided for abutting an upstream ramp of the tooth with the blocking levers in the operative configuration.

8. A device for removably blocking a central-front part of a ski boot to a platform of a ski for actuating a Telemark technique comprising: a plate, blockable to the ski platform; a blocking device constrained to the plate, which bear at least two ratchets, which ratchets are associated with a sole of the ski boot supported by the plate located at corresponding lateral front parts of the boot; an activator for the blocking device, supported by the plate, the activator defining two configurations of the blocking device, an inoperative configuration with the disengagement of the ratchets from the corresponding lateral front parts of the boot, and an operative configuration with the blocking of the ratchets to the corresponding lateral front parts of the boot, so as to block a central-front part of the boot sole to the plate and so that a rear part of the boot can oscillate with respect to the central-front part, wherein the blocking device comprises two blocking levers centrally hinged by relative vertical pins to the plate, internal ends of internal arms of the levers connected to the activator, external arms of the blocking levers comprising, starting from the relative vertical pin, three consecutive portions, respectively a first portion developing in an external direction, a second portion and a third portion, identifying, in combination, a T-shape defining the ratchet, with a stalk of the T-shape inserting, with the blocking levers in the operative configuration, in a corresponding undercut realized in a relative front lateral edge of the boot and with the head of the T-shape destined to block the edges against the plate with the blocking levers in the operative configuration.

9. The device of claim 8, further comprising at least two blocks solidly constrained to the plate, having seatings for receiving corresponding first portions of the blocking levers, when the blocking levers are in the operative configuration.

10. The device of claim 8, wherein the activator comprises a slide which is slidably guided longitudinally by the plate, an internal end of which is hinged to the internal ends of the internal arms of the blocking levers; a device for drawing the slide in an operative direction, for switching the blocking levers from the inoperative configuration to the operative configuration acting against an elastic element.

11. A device for removably blocking a central-front part of a ski boot to a platform of a ski for actuating a Telemark technique comprising: a plate, blockable to the ski platform; a blocking device constrained to the plate, which bear at least two ratchets, which ratchets are associated with a sole of the ski boot supported by the plate located at corresponding lateral front parts of the boot; an activator for the blocking device, supported by the plate, the activator defining two configurations of the blocking device, an inoperative configuration with the disengagement of the ratchets from the corresponding lateral front parts of the boot, and an operative configuration with the blocking of the ratchets to the corresponding lateral front parts of the boot, so as to block a central-front part of the boot sole to the plate and so that a rear part of the boot can oscillate with respect to the central-front part, wherein the blocking device comprises two blocking levers, centrally hinged by two vertical pins to the plate, internal ends of internal arms of the levers connected to the activator, external arms of the blocking levers comprising, starting from the relative vertical pin, two consecutive portions, respectively a first portion developing in an external direction and a second portion developing upwards, and exhibiting a transversal hole, the second portion inserting, with the blocking levers in the operative configuration, in a corresponding undercut realized in the relative front lateral flank of the boot, the transversal hole receiving a corresponding pin provided in the undercut as a consequence of the defining of the operative configuration of the blocking levers.

12. The device of claim 11, further comprising at least two blocks solidly constrained to the plate, having seatings for receiving corresponding first portions of the blocking levers, when the blocking levers are in the operative configuration.

13. The device of claim 11, wherein the activator comprises a slide which is slidably guided longitudinally by the plate, an internal end of which is hinged to the internal ends of the internal arms of the blocking levers; a device for drawing the slide in an operative direction, for switching the blocking levers from the inoperative configuration to the operative configuration acting against an elastic element.

* * * * *